US007311415B1

(12) United States Patent
Burnidge

(10) Patent No.: US 7,311,415 B1
(45) Date of Patent: Dec. 25, 2007

(54) ILLUMINATED HOLIDAY TREAT CARRIER

(76) Inventor: Lane E. Burnidge, 17 N. 400 Big Timber, Hampshire, IL (US) 60140

( * ) Notice: Subject to any disclaimer, the term of this patent is extended or adjusted under 35 U.S.C. 154(b) by 401 days.

(21) Appl. No.: 11/015,478

(22) Filed: Dec. 17, 2004

Related U.S. Application Data

(63) Continuation-in-part of application No. 10/738,480, filed on Dec. 17, 2003, now Pat. No. 6,869,199, which is a continuation of application No. 09/875,822, filed on Jun. 6, 2001, now abandoned.

(51) Int. Cl.
*F21V 33/00* (2006.01)

(52) U.S. Cl. ..... 362/154; 362/109; 362/251; 362/806

(58) Field of Classification Search ..... 362/154, 362/155, 156, 109, 101, 806, 34, 249, 234, 362/253, 577, 562
See application file for complete search history.

(56) References Cited

U.S. PATENT DOCUMENTS

| | | | | |
|---|---|---|---|---|
| 5,567,054 | A * | 10/1996 | Dalgleish | 362/156 |
| 5,836,671 | A * | 11/1998 | Chien | 362/84 |
| 6,152,572 | A * | 11/2000 | Cutler | 362/155 |
| 2004/0012956 | A1 * | 1/2004 | Chen | 362/240 |

* cited by examiner

*Primary Examiner*—Ali Alavi
*Assistant Examiner*—Bao Q. Truong
(74) *Attorney, Agent, or Firm*—Michael Ries

(57) ABSTRACT

Provide is an improved, lower cost, illuminated carrier which is more economical to transport and warehouse. An illuminated carrier for articles, said carrier having a container a attachment for said container, said attachment having illuminating means mounted thereon; and a handle means.

3 Claims, 6 Drawing Sheets

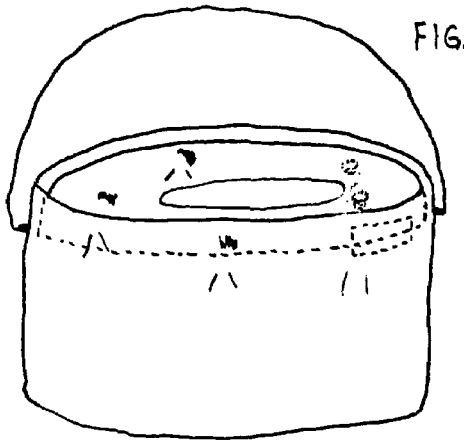
FIG. 6
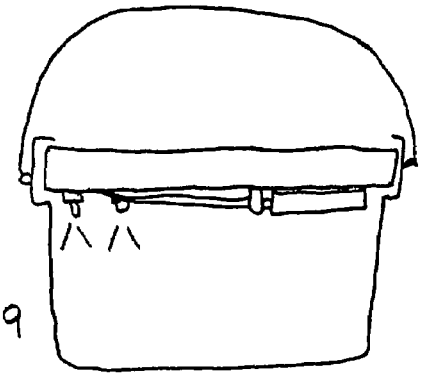
FIG. 9
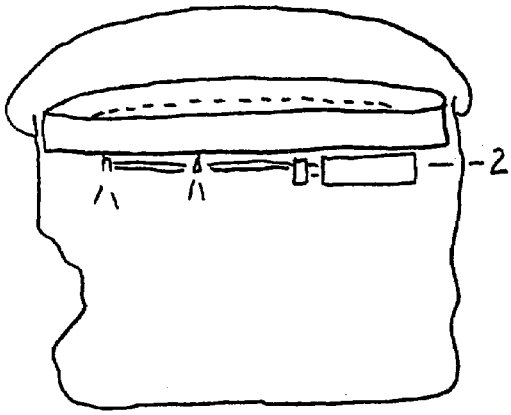
FIG. 7
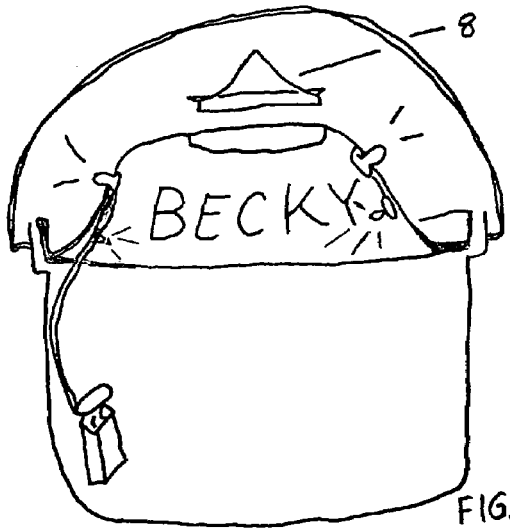
FIG. 10
FIG. 8
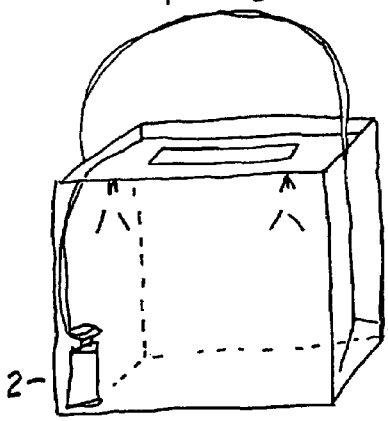
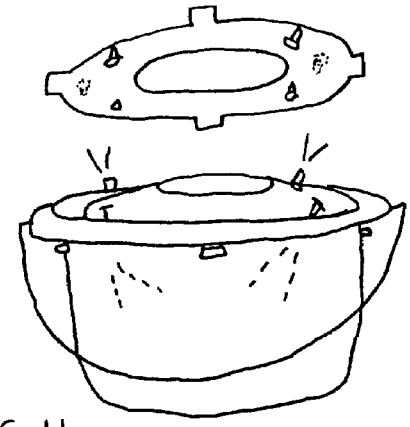
FIG. 11

FIG. 12
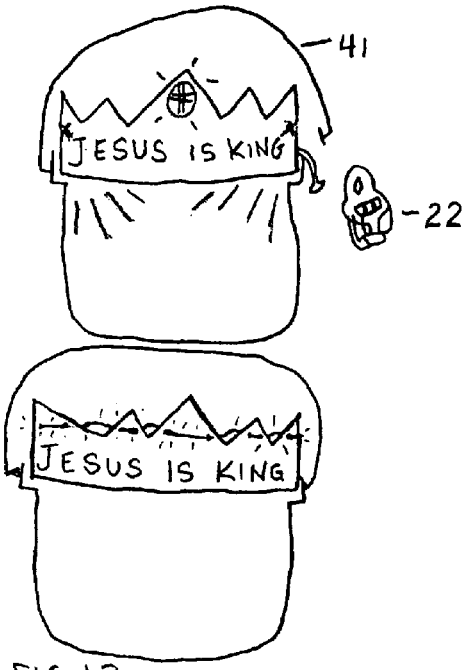
FIG. 15
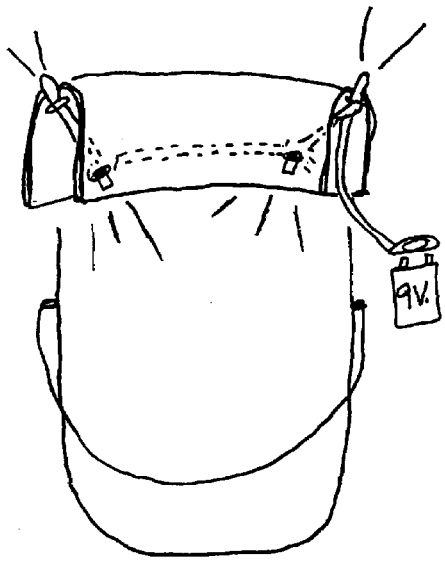
FIG. 13
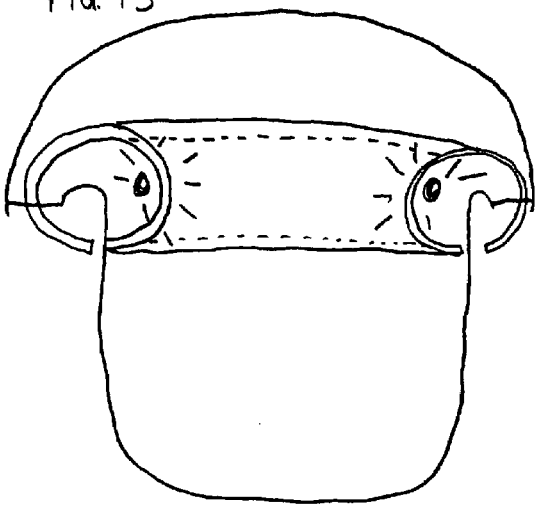
FIG. 14
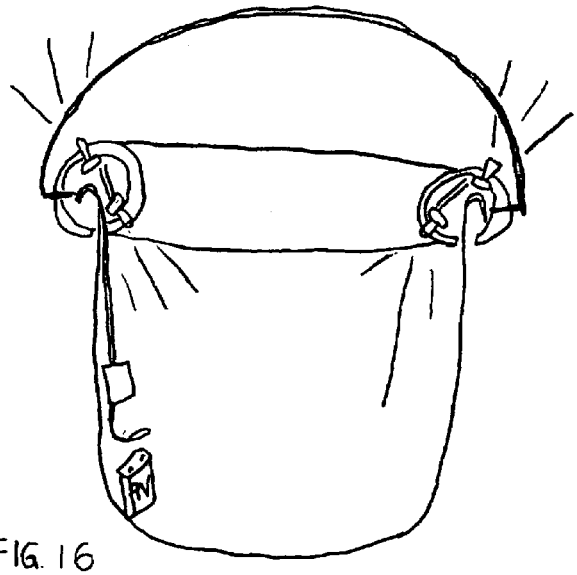
FIG. 16

ILLUMINATED HOLIDAY TREAT CARRIER

CROSS-REFERENCE TO RELATED APPLICATIONS

This is a continuation-in-part of application Ser. No. 10/738,480, filed Dec. 17, 2003 now U.S. Pat. No. 6,869, 199, which is a continuation of application Ser. No. 09/875, 822, filed Jun. 6, 2001, now abandoned.

BACKGROUND OF THE INVENTION

1. Field of the Invention

The present invention relates to an improved illuminated carrier for articles such as Halloween and other holiday treats.

2. Description of Related Art

Typically, the tradition of trick or treating at Halloween is done at dusk and into the night when the danger to a child not being seen by approaching motor vehicles is greatest. To minimize this danger, the child is often required to carry a flashlight or a battery-powered lantern to warn drivers of motor vehicles of the child's presence. For younger children, this method is cumbersome, as the child is required to carry both a container for carrying the collected treats and a flashlight or lantern and the degree of safety for the child is thereby diminished. Additionally, novel carriers are generally sought by children and their parents, especially those that provide safety features, such as illumination. The costs associated with the assembly of such carriers, however, is high, therefore lower assembly costs are desirable. Additionally, bulk shipping and warehousing costs per unit of the finished carrier is generally substantial due to the prior art carriers being of a fanciful or other such shape which cannot be nested or stacked within each other.

While various treat-carrying jack-o-lanterns and the like have been developed in the past to overcome the shortcomings of carrying both a flashlight or battery-powered lantern and a trick or treat bag or container, their commercial success has been limited.

U.S. Pat. Nos. 4,698,732 and 4,714,985, for example, describe carriers for treats and other articles which have either a single or double bottom and which employ a flashlight insert. Further, in both inventions, the light beam is directed downward, thereby providing minimal illumination to motorists.

U.S. Pat. No. 4,802,071 describes a lantern candy carrier which employs a battery-powered light source. Because of its fanciful shape, it is not nestable or stackable thereby increasing transporting and warehousing costs.

U.S. Pat. No. 4,926,296 describes another attempt to provide a battery powered, illuminated carrying bag for transporting articles. While the bag provides some of the economies present in the present invention, it does not provide the omni-directional illumination needed for child safety. Instead, the light only shines through the transparent portion of the front sidewall.

Further, U.S. Pat. No. 5,597,230 describes an ornamental carrier with flashlight-type eyes. This lighting means, like that of the '296 patent above, provides only uni-directional lighting and fails to provide adequate warning of the child's presence to an approaching motor vehicle unless the face of the ornamental carrier is pointed toward the motor vehicle. Additionally, the shape of the carrier does not allow for economical transporting or warehousing.

U.S. Pat. No. 6,200,000 describes an improved illuminated carrier which overcomes many of the shortcomings of the other prior art carriers, but lacks nestability and stackability which increases the costs of transporting and warehousing.

Although these prior art treat carriers provide children with varying degrees of safety at night, as well as novelty, the costs of assembly, transportation and warehousing of the finished articles are generally too high. The need for an easily assembled and stackable, less expensive carrier is evident. The present invention overcomes the assembly, transportation and warehousing shortcomings of the prior art carriers by providing a lower cost, nesting, stackable or collapsible carrier employing readily available, translucent containers with a modified snap ring, tubular split ring, sleeve, or wedge fit inner cover. To permit nesting of the containers, their geometry shall be that of an inverted truncated cone or such other shape which would permit them to be stacked one inside the other during shipment and warehousing. At the distribution or sale site, the covers with their illuminating means can be attached to the container, thus providing the finished product. If collapsible containers are employed, however, nestability is obviated and the article carriers can be transported and warehoused as completely assembled units.

BRIEF SUMMARY OF THE INVENTION

It is a general object of the present invention to provide an improved, lower cost, illuminated container and a snap ring, tubular split ring or wedge fit inner cover having an opening in the cover sufficient for the insertion and removal of articles such as Halloween or other holiday treats. One preferred circuitry of the illuminating means is more fully described in U.S. Pat. No. 6,200,000, which circuitry is secured around the underside of the cover. When employing containers which have existing bails or handles attached to or through the upper outer walls of the container, the need for the handle of the lift actuated switch described in the '000 patent is unnecessary. A slide, toggle, or other type switch may be employed to actuate the electrical circuitry; or, in the alternative, a battery holder which allows ease of insertion and removal of the electrical power source, may be employed as the switch means. It is a more particular object of the present invention to provide an improved, lower cost, illuminated carrier which is more economical to transport and warehouse.

BRIEF DESCRIPTION OF THE DRAWINGS

The accompanying drawings, which are incorporated into and constitute part of this specification, illustrate preferred embodiments of the invention, and together with the detailed description below, serve to explain the invention in greater detail.

FIG. 6 illustrates a container with illumination in accordance with the present invention;

FIG. 7 illustrates a container with illumination in accordance with the present invention;

FIG. 8 illustrates a container with illumination in accordance with the present invention;

FIG. 9 illustrates a container with illumination in accordance with the present invention;

FIG. 10 illustrates a container with illumination in accordance with the present invention;

FIG. 11 illustrates a container with illumination in accordance with the present invention;

FIG. 12 illustrates a container with illumination in accordance with the present invention;

FIG. 13 illustrates a container with illumination in accordance with the present invention;

FIG. 14 illustrates a container with illumination in accordance with the present invention;

FIG. 15 illustrates a container with illumination in accordance with the present invention;

FIG. 16 illustrates a container with illumination in accordance with the present invention;

DETAILED DESCRIPTION OF THE INVENTION

The following description is provided to enable one skilled in the art to make and use the invention and sets forth the best mode of the invention. Variations of the invention will be readily apparent to those skilled in the art.

Figure 1:
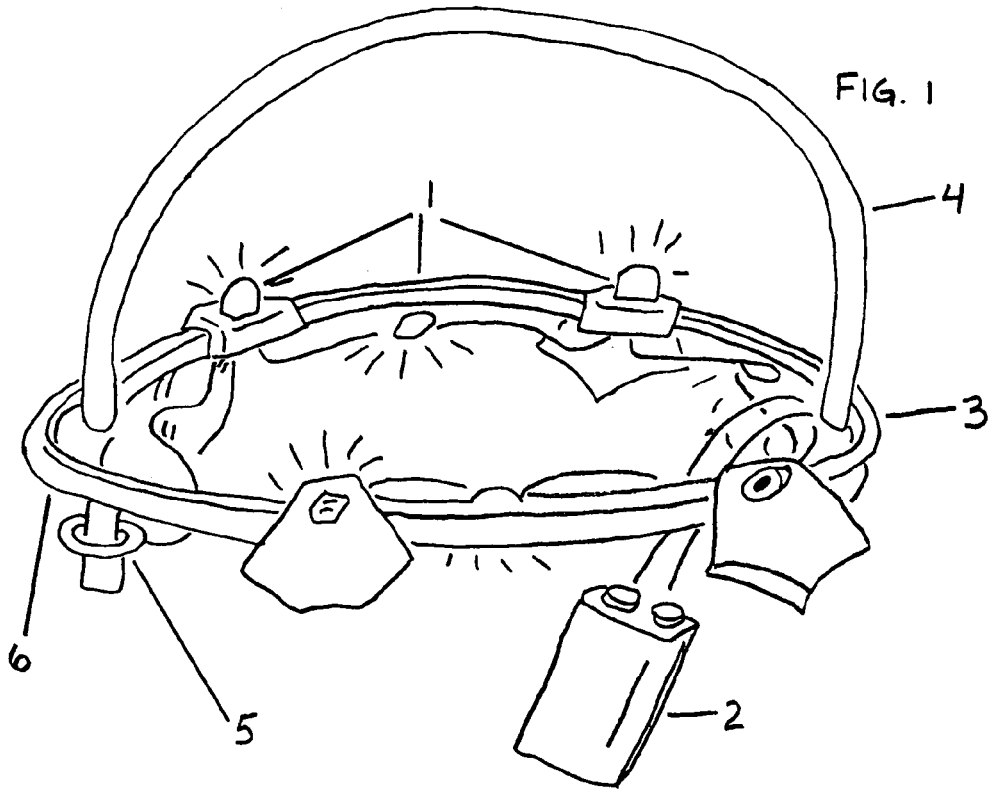
FIG. 1 is a sectional view of a snap ring inner cover with a dry cell battery in circuit with light emitting means.

In FIG. 1, a plurality of light emitting means 1, are wired in a parallel or series circuit with a dry cell battery 2, and mounted on the underside of a snap ring cover of rigid or semi-rigid, and preferably, translucent plastic 3 and to which one end of a rigid or semi-rigid plastic handle 4 is mounted on the upper surface of the snap ring cover and the other end of the handle is inserted through an opening in the upper surface of the snap ring directly opposite of the mounted end of the handle, said handle end having an electrical conducting material or contact 5 attached to and around the free end of the handle and to which the wire forming one side of the electrical circuit is attached.

An opening of sufficient diameter should be provided to allow the free end of the handle to be inserted through and slide within the opening without binding. The free end of the handle should be of such length to protrude through such opening and extend below the underside of the snap ring cover a sufficient distance to allow the electrical circuit to be broken when there is no lifting of the handle. Between the underside of the snap ring cover and the terminus of the free end of the handle on which the electrical conducting material or contact is attached is a circular shaped metal contact 6 fastened to the underside of the snap ring cover and having an opening through which the handle is inserted. This metal contact 6 is attached to one end of the electrical wire forming the other end of the circuit to which the contact end of the handle is attached. The opening in the circular portion of this metal contact should be of sufficient diameter to allow the free end of the handle to slide within it without binding when the hollow plastic container, around which the snap ring cover has been attached and secured, is lifted by the handle, yet should have an inside diameter which is smaller than the outside diameter of the electrical conducting material or contact 5 attached to the free end of the handle to prevent the free end of the handle from passing through the inside diameter of metal contact 6. When the snap ring cover has been secured on the hollow plastic container and the container is lifted by the handle, the weight of the container causes the electrical contacts 5 and 6 to touch completing the electrical circuit and powering the light emitting diodes or incandescent lamps thereby illuminating the rim of the snap ring cover and inside walls of the container.

Figure 2:
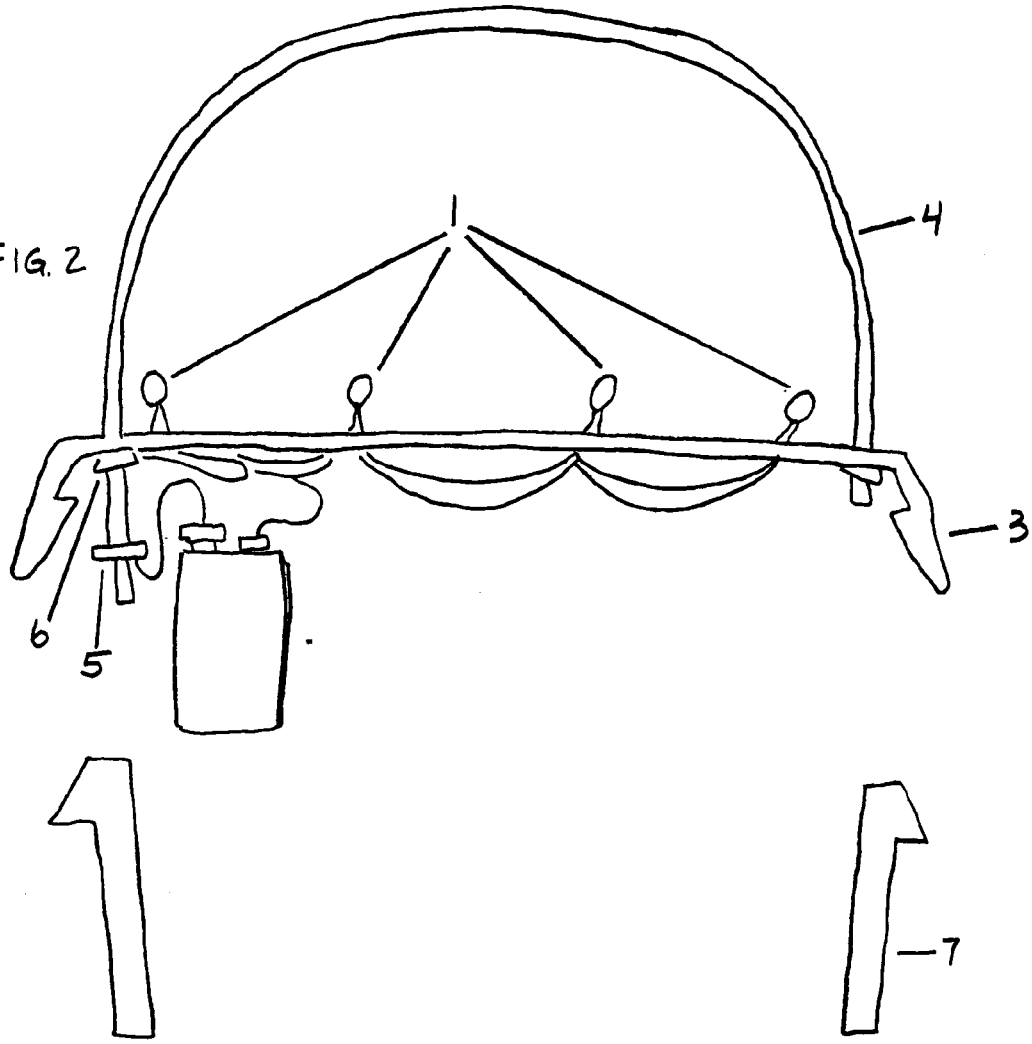
FIG. 2 is a fragmentary sectional view of the outer edge of an snap ring inner cover and upper inner edge of the container body.

FIG. 2 illustrates a cross sectional view of the snap ring inner cover 3 and a fragmentary cross sectional view of the container 7.

Figure 3:
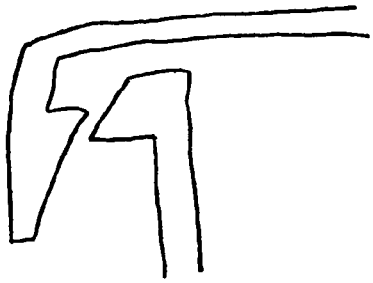
FIG. 3 is a fragmentary sectional view of a transparent tubular split ring containing light emitting means encased therein and which is mounted over and around the top edge of a container having a bail or handle attached to the upper outer walls of the container.

FIG. 3 is a fragmentary sectional view of a transparent split ring 1 containing light emitting means 2 encased therein and which is mounted over and around the top edge of a container 3 having a bail or handle 4 mounted on its upper outer edge.

Figure 4:
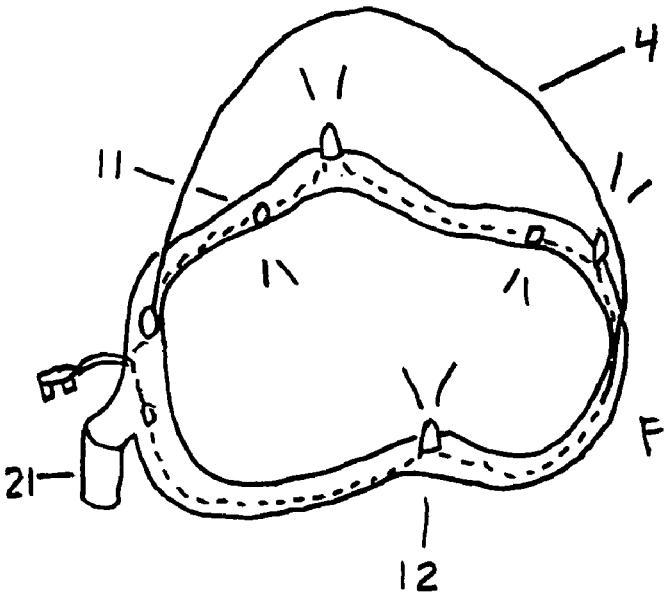
FIG. 4 illustrates a perspective view of a cover having equidistantly molded tabs around its outer edge and a handled container with the equidistantly placed openings in its sidewall.

FIG. 4 illustrates a perspective view of a cover 1 absent any illuminating means and having equidistantly molded tabs 2 extending beyond and around the outer edge of said cover and mateable with the equidistantly placed openings 3 in the sidewall of said container 4, A handle or bail 5 is attached to the upper outer wall of the container 4.

The snap ring inner cover with the illuminating means is secured to the top of the inside wall of the hollow plastic container by pushing the cover downward over and past the inner wall protrusions of the container, or, if the transparent split ring illuminating means is employed, by slipping the split ring over and around the top of the container; either of which steps can be easily accomplished at the final distribution or sale site, thus allowing economy of transportation and warehousing costs. Other means of attaching the illuminating cover of the present invention to the container can be employed with equivalent success, such as securing the cover within the container by molding a groove in the upper inner wall of the container into which the cover is secured or by molding tabs equidistant around the perimeter of the cover and like equidistant openings in the upper wall of the container to receive the tabs of the cover. Such alternate securing means will be readily apparent to those skilled in the art.

The choice of electrical circuitry, whether parallel or series; the choice of the size and number of light emitting diodes, incandescent lamps or other lighting means, whether flashing or not; along with their respective voltage requirements for the light emitting means; is determinative of the size and number of dry cell batteries desired to be employed. For economy of battery life and intensity of illumination, light emitting diodes are preferred. When light emitting diodes are used alone or in combination with a solid state electronic circuit flashing device, a nine volt dry cell battery is preferred as the power source. Electroluminescent materials, with inverter drivers, also can be employed as illuminating means when economy of battery life is desired.

For those applications where non-electrical illumination is preferred, chemical luminescent materials can be readily substituted on the treat carrier.

While the above drawings describe several embodiments of the invention, other variations are contemplated to be within its scope, including employment of a carrying handle attached to the container instead of the cover, as well as a non-switch handle mounted on the cover. Such non-switch handle variations may or may not require a switch located elsewhere on the cover or container.

The various aspects of the invention provide a novel concept for a lower cost carrier for articles such as Halloween treats and the like and provides for increased safety for children from the danger of not being seen by approaching motor vehicles, as well as economy of transport and warehousing of the product.

While the present invention has been illustrated by the description of the preferred embodiments, it is not the intention of the applicant to in any way limit the scope of the appended claims. Additional modifications and advantages will be readily apparent to one skilled in the art. Therefore, the invention's scope is not to be limited to the specific described embodiments.

Figure 5:
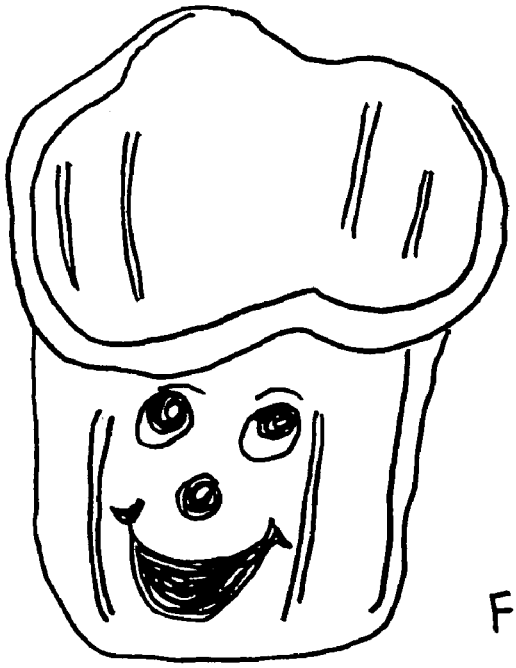
FIG. 5 illustrates a wavy top container in accordance with the present invention.

FIG. 4 is an illuminating rim for a translucent container formed to mate onto the wavy top container in FIG. 5. This rim is similar to FIG. 1 with the addition of battery holder 21 molded on the outside. Light emitting means 11 are press fit from the underside aimed down into and onto the opposite side of the inside of the container making it visible from a distance. Upright light emitting means 12 can be flashing and are also press fit. Handle 4 can also be a lift activated switch as in FIG. 1. Wires are concealed between the illuminating rim and the top of the container.

FIG. 6. FIG. 7, FIG. 8. FIG. 9 are containers illuminated by a lid where the illuminating components are on the underside. Battery 2 may be attached to the lid (as in FIG. 7) set inside the container as in FIG. 8 or hung from a separate battery holder on the outside of the container as in FIG. 12. The lids in FIG. 6, FIG. 7, FIG. 8, FIG. 9 all have an upright flange on the top of the lid and the illuminating components on the bottom side. FIG. 6 is straight sided or almost straight sided when made in a nestling shape. The flange of the lid is a sleeve inside the top of the container and can be glued, riveted, stapled, welded, sewn or attached by other various means.

FIG. 7 is a collapsible container made of plastic or cloth illuminated by the lid with its components on the underside of the lid and the flange above making it easy to assemble. FIG. 8 is a rectangular container made of paper or plastic, rigid, semi rigid or collapsible with the illuminating lid flange up for easy attaching inside the container. FIG. 9 is a container with molded groove on the inside where the illuminating lid is snap fit into the mouth of the container. This groove could be wide enough to accept a lid, flange up or flange down or be only a slot to accept and hold a lid without a flange. FIG. 10 is a lid with upright flange similar to lids in FIG. 6, FIG. 7, FIG. 8, FIG. 9. The container has a molded inside ledge which the lid rests on. This lid is convex with an additional lid covering the opening. Light emitting means are aimed inside to illuminate the container and its contents and aimed upward to make the container and lid visible. The container may or may not be translucent.

FIG. 11 is a container with slots (mortises) which accept a semi rigid flat with light emitting means attached. This lid has tenons which hold the lid on the container. FIG. 12 is a container with an inside ledge as in FIG. 10. The illuminating ring is a sleeve standing above the container with light emitting means on the sleeve aimed both into the container and out from the container (in this configurement, out from the center of the cross). Battery holder 22 has a hole in it that the handle 41 passes through before being attached to the container. FIG. 13 is an illuminating sleeve ring similar to FIG. 12 using chemical tube light (break and glow) or electro luminescent light emitting means with the illuminating means laced through holes in the sleeve ring illuminating both the inside and visible from the outside of the container.

FIG. 14 and FIG. 16 are containers illuminated from a sleeve made of semi rigid translucent or clear flexible tubing. This tubing has a slot or slit on the underside which allows the tube to accept light emitting means. The illuminating tube is then pressed over the lip of the container and holds itself onto the container because of the memory of the plastic. FIG. 14 shows a container illuminated with chemical light (break and glow tube) or with electro luminescent light emitting means inside a tubular ring.

Figure 17:
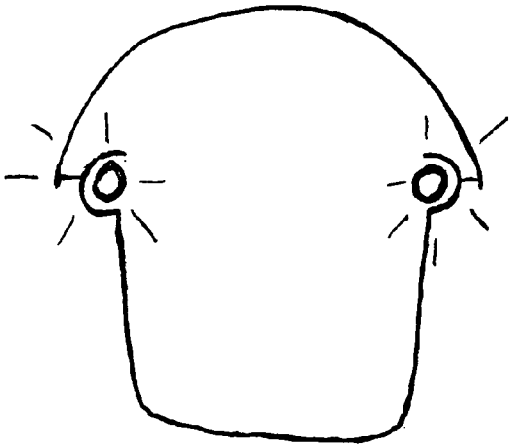
FIG. 17 illustrates a container with illumination in accordance with the present invention.

FIG. 15 is a straight sided container with cut away view of a sleeve with light emitting means, in this case L.E.D. or incandescent bulbs aimed both into the container and away from the container. The sleeve/ring contains and protects the wiring. FIG. 16 is the tube/ring of FIG. 14 with light emitting means aimed into or away from the container flashing, non flashing or both. Wires are inside the tube and battery is in the container. FIG. 17 illustrates an illuminated container with an inside groove which holds a tubular illuminating ring. The ring can contain L.E.D's, electro luminescent, chemical light or incandescent light.

Figure 19:
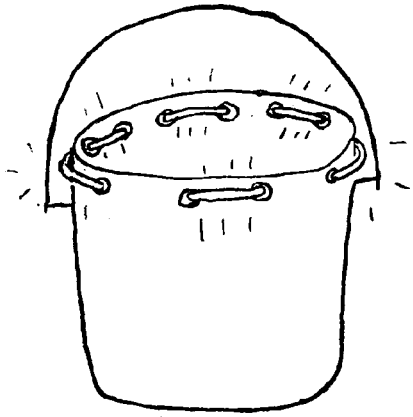
FIG. 19 illustrates a container with illumination in accordance with the present invention.
Figure 18:
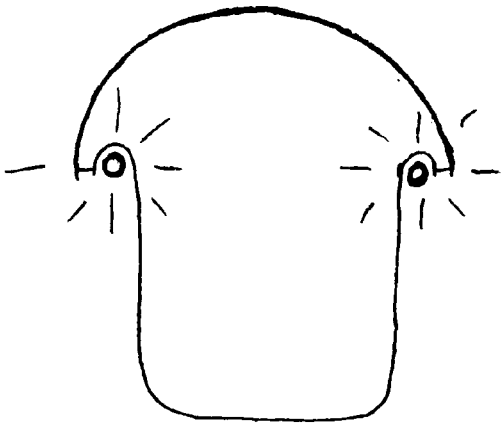
FIG. 18 illustrates a container with illumination in accordance with the present invention.
Figure 20:
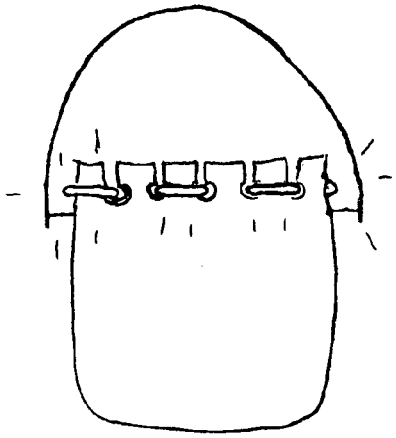
FIG. 20 illustrates a container with illumination in accordance with the present invention.

FIG. 18 illustrates a container illuminated from a ring similar to FIG. 17, snapped up under the lip of the container. FIG. 19 illustrates a container where the illuminating means is threaded through holes near the top of the container. The illuminating means could be L.E.D.'s or incandescent lamps on a strip or in a tubular sleeve or chemical light in a tube or electro luminescent forming an illuminating ring on the container. FIG. 20 illustrates a container where the illuminating ring slips down into keyhole shaped slots around the top of the container. The illuminating means could be light emitting diodes, chemical luminescent, electro luminescent or incandescent.

The invention claimed is:

1. An illuminated carrier for articles, said carrier comprising:

a container wherein said container has a molded protrusion around the inner upper edge of said container;

a cover mountable within said container, said cover comprising:

a molded protrusion around the outer edge of said cover, the outer diameter of said protrusion of said cover being of a diameter greater than the inner diameter of said protrusion of said container, but smaller than the inner diameter of the sidewall of said container at said protrusion;

an opening through the upper top portion of said cover;

one or more light emitting means mounted on said cover and around and inside the outer edge thereof, said light emitting means being in circuit with a power source;

a switch means connected to said power source for actuating said light emitting means and;

a handle means.

2. The container and cover of claim 1 wherein said container and cover are translucent plastic.

3. An illuminated carrier for articles, said carrier comprising:

a container having equidistantly placed openings through and around the sidewall and parallel to the upper edge of said container;

a cover for said container, said cover comprising:

equidistantly molded tabs extending beyond and around the outer edge of said cover and mateable with the equidistantly placed openings in the sidewall of said container, the outer diameter formed by said tabs being greater than the inner diameter of said container at said equidistantly placed openings;

an opening through the upper top portion of said cover;

one or more light emitting means mounted on said cover and around and inside the outer edge thereof, said light emitting means being in circuit with a power source;

a switch means connected to said power source for actuating said light emitting means; and a handle means.

* * * * *